US009681758B2

(12) United States Patent
Lau

(10) Patent No.: US 9,681,758 B2
(45) Date of Patent: Jun. 20, 2017

(54) DUAL STRAP SLING CARRIER WITH SUPPORT SLEEVE

(71) Applicant: Michelle Lau, Las Vegas, NV (US)

(72) Inventor: Michelle Lau, Las Vegas, NV (US)

( * ) Notice: Subject to any disclaimer, the term of this patent is extended or adjusted under 35 U.S.C. 154(b) by 0 days.

(21) Appl. No.: 14/830,664

(22) Filed: Aug. 19, 2015

(65) Prior Publication Data

US 2017/0049246 A1 Feb. 23, 2017

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02; A45F 3/02; A45F 2003/025; A45F 2003/002; A45F 2003/007; A45F 3/00; A45C 1/02
USPC ..... 224/158–161, 600–602, 607, 623
See application file for complete search history.

(56) References Cited

U.S. PATENT DOCUMENTS

D407,213 S * 3/1999 McConnell ..... D3/213
6,467,665 B1 * 10/2002 Jenkins ..... A45F 3/04 224/628
8,523,028 B1 9/2013 Young
2008/0072838 A1 3/2008 Beach et al.
2010/0187268 A1 * 7/2010 Rosen ..... A47D 13/025 224/158
2011/0127309 A1 6/2011 Chua
2011/0226822 A1 9/2011 Higuchi
2012/0074182 A1 * 3/2012 Harris ..... A47D 13/025 224/160
2013/0298844 A1 11/2013 Wernick et al.

FOREIGN PATENT DOCUMENTS

CA 2760712 6/2013
DE 102010021611 A1 * 12/2011 ..... A45C 3/00
WO 2007/143187 12/2007

OTHER PUBLICATIONS

[Fundle petsling] Communion Pocket Type pet carrier100% Hand Made in Korea, buyKorea, http://www.buykorea.org/product-details/-fundle-petsling-communion-pocket-type-pet-car, 6 pages, Aug. 13, 2015.

* cited by examiner

*Primary Examiner* — Nathan J Newhouse
*Assistant Examiner* — Scott McNurlen
(74) *Attorney, Agent, or Firm* — Weide & Miller, Ltd.

(57) ABSTRACT

A carrier is provided for carrying an infant, a baby, or a small animal. The carrier includes a pouch that is formed from a main bottom panel and side panels attached to the main bottom panel in which the infant, the baby, or the small animal may sit. The side panels form a resting notch which may be v-shaped at a top edge of at least one of the side panels. Two or more straps are attached to opposite side panels of the pouch and are formed to extend over a wearer's shoulders. The carrier further includes a sleeve disposed underneath the pouch and attached to the pouch. The sleeve allows the wearer's hand or arm to extend therethrough. When the wearer uses the sleeve, the wearer may provide added comfort and support to the infant, baby, or small animal being carried.

13 Claims, 3 Drawing Sheets

DUAL STRAP SLING CARRIER WITH SUPPORT SLEEVE

BACKGROUND

1. Field

The disclosed embodiments relate carriers. More specifically, the disclosed embodiments relate to wearable infant, toddler, or pet carriers.

2. Related Art

In society, past and present, it has been customary for parents and caregivers, to carry their infant children, babies, or small animal pets, against their body, side, chest or back, using a sling-like arrangement of fabric, woven fiber or the like. Over the last few years, interest in the traditional practice of carrying an infant, baby, or small animal with the convenience of being hands free has become considerably heightened in the United States and around the world. It has become increasingly recognized that the practice has advantages for the infant, baby, or small animal, as well as for the caregiver.

With a well-designed body worn carrying apparatus or sling like carrier, a person is largely free to go about her or his business while carrying, comforting or transporting the infant, baby, or small animal with them. This may allow them to introduce and teach them about their surroundings, while offering them a level of protection and safety. The infant, baby, or small animal being carried has an improved state of well-being from being closely associated with carrier. Further, the infant, baby, or small animal may be prevented from being overwhelmed by a feeling of separation or of being alone in the world and may have enhanced visual and auditory experiences. The infant, baby, or small animal is also protected and removed from potential situations and surrounding elements that may harm them.

Some traditional baby carrier slings are designed for supporting the infant, baby, or small animal on the carrier's hip, while others are designed for supporting the infant, baby, or small animal on the carrier's back or chest. Sometimes, it is obvious from the way that the infant is twisting her neck about that she would rather be looking out at what is going on around her than to be faced with the relative sameness of their carrier's back or chest. Similarly, the infant, baby, or small pet may want to look from one side or another. However, traditional worn sling-type carriers fail to provide an infant, baby, or small animal with the choice of either left, right, front, or back facing positions. Further, known carriers fail to provide accommodating areas for an infant, baby, or small animal's head or other body parts to easily rest and be supported in each of these directions.

Also, traditional carriers are typically configured to be worn in one predetermined way. Thus, the carrier has one, predefined look, and accommodates the infant, baby, or small pet only in the predefined configuration. Often sling-type carriers are difficult to assemble, adjust, and put on. Further, many carriers and must be partially or completely disassembled in order to insert and remove the infant, baby, or small animal, when loading and unloading them into the carrying pouch. Further, sling-type carriers with a single strap may be difficult and uncomfortable for a wearer such as when the wearer is seated or in another position. This may create tension in the wearer's neck and back making it necessary to disturb and remove the infant, baby, or small animal held inside the carrier pouch.

While the benefit of traditional carriers allows the wearer to carry the infant, baby, or small animal hands-free, often the wearer wishes to place their hand or hands somewhere in contact with the infant, baby, or small animal, as a safety or comfort measure for the baby, infant, or small animal. Further, the wearer may move and position the carrier in relation to her or his body. This may be to sooth, support, comfort, or otherwise provide emotional and physical reassurance to the wearer and the infant, baby, or small animal. Often, this may also simply be for the wearer or wearer's hands and arms, to be in a more comfortable position while walking or in a standing or sitting position. Typical carriers, however, fail to provide an easy way for the wearer to interact with the carrier as described above.

SUMMARY

The disclosed embodiments have been developed in light of the above. The embodiments thus may include a method and design for a body worn carrying apparatus to help a wearer hold, carry, or transport an infant, baby, or small animal with or without the use of their arms and/or hands. The wearer may use the carrier hands free or may use her or his arms in a variety of positions that allows the wearer to lift, soothe, bond and comfort the infant, baby, or small animal. In one embodiment, the carrier may include a support sleeve disposed on a carrying pouch. The wearer may thus insert her or his hands and/or arms into the support sleeve on the pouch, while the infant, baby, or small animal is suspended in the apparatus.

In other embodiments, the body worn carrying apparatus may include dual straps and a pouch comprised of overlapping slanting panels. The pouch may be assembled to provide head and body resting notches that also create storage pockets on all sides of the carrier.

In another exemplary embodiment, a carrier is provided for carrying an infant, a baby, or a small animal. The carrier includes a pouch that is formed from a main bottom panel and side panels attached to the main bottom panel in which the infant, the baby, or the small animal may sit. The side panels form a resting notch at a top edge of at least one of the side panels. Two or more straps are attached to opposite side panels of the pouch and are formed to extend over a wearer's shoulders. The carrier further includes a sleeve disposed underneath the pouch and attached to the pouch. The sleeve allows the wearer's hand or arm to extend therethrough. When the wearer uses the sleeve, the wearer may provide added comfort and support to the infant, baby, or small animal being carried.

In the above-described carrier, at least one of the side panels may comprise overlapping panels. The overlapping panels have a diagonal top edge. The diagonal top edge of the overlapping panels may thus form the resting notch as a v-shaped notch. The overlapping panels may also form a storage compartment between the overlapping panels.

The two or more straps may be configured to be adjustable. The sleeve may be disposed to extend from under the pouch to at least partially up the opposite side panels. The straps may connect to the side panels via hoops.

In yet another exemplary embodiment, a carrier for carrying an infant, a baby, or a small animal may include a pouch that has a main bottom panel and side panels in which the infant, the baby, or the small animal may sit. At least one strap is attached to opposite side panels, and a sleeve is disposed underneath the pouch and is attached to the pouch.

In this carrier, the side panels may include front, rear, and lateral panels, and the straps may attach to the lateral panels. The side panels include overlapping panels having a diagonal top surface, the side panels forming a v-shaped notch. The side panels may also include a storage pocket between the overlapping panels.

The strap may be adjustable in length. A first side of the strap may be connected to the side panels via a hoop and a second side of the strap may be integrally formed with the side panels. In other embodiments, both sides of the strap may be connected to the side panels via hoops. The sleeve may be formed to extend from under the pouch to at least partially up the opposite side panels.

In another embodiment, there is a carrier for carrying an infant, a baby, or a small animal that includes a pouch having a main bottom panel and side panels attached to the main bottom panel. The side panels extend upwards from the main panel to form the pouch in which the infant, the baby, or the small animal may sit. The carrier has at least one strap attached to opposite side panels. The side panels form a resting notch at a top edge of at least one of the side panels.

The above carrier may have two straps that are configured to be worn with both straps on one shoulder or with one strap on each shoulder. The carrier may also have a sleeve disposed underneath the pouch and attached to the pouch. The sleeve may be formed to extend from under the pouch to at least partially up the opposite side panels. The side panels may include overlapping panels with diagonal top edges, the overlapping panels forming the resting notch as a v-shaped notch.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

The disclosed embodiments relate to infant, baby, or small animal sling-type carriers. More particularly the disclosed embodiments relate to infant, baby, or small animal carriers having two independently functioning adjustable straps that can be placed to on the wearer to alter the look and carrying positions, that is assembled with diagonal edged layers in an opposite, overlapping fashion, that creates head and body resting notches and storage pockets, and that comprises a support sleeve assembled with or attached to the pouch of the carrier to provide emotional and physical support and assistance.

A carrier according to the disclosed embodiments allows a wearer to transport or carry an infant, baby, or small animal against the wearer's body, with or without the use of their hands. The wearer may hold the infant, baby, or small animal in a variety of positions allowing the user to emotionally and physically support and connect with the infant, baby, or small animal. The carrier further allows the wearer to support the infant, baby, or small animal with their hand, hands, arm, or arms inserted from one or both openings on either end of the support sleeve while the infant, baby, or small animal is suspended in the carrier.

Figure 1:
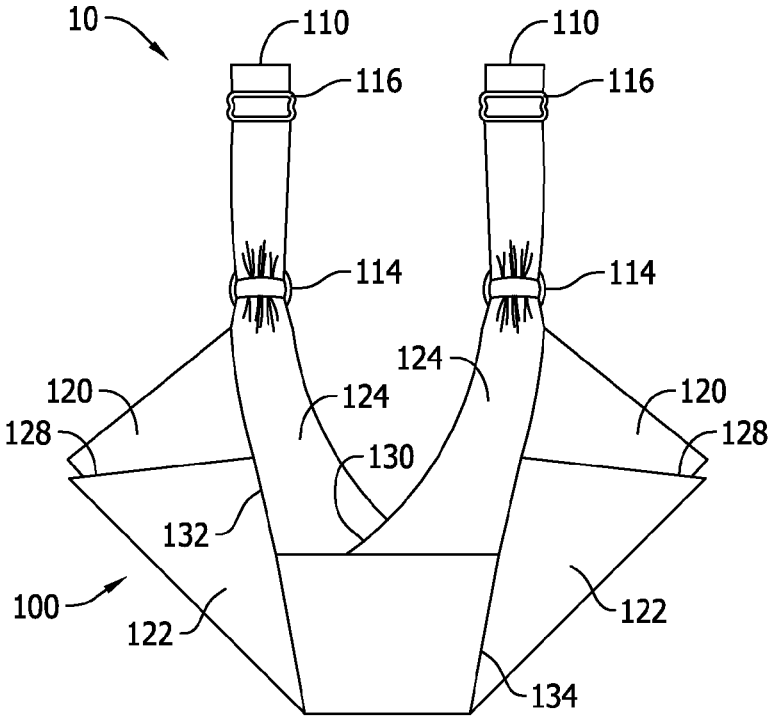
FIG. 1 shows a side view of a carrier for an infant, baby, or small animal, according to an exemplary embodiment.
Figure 2:
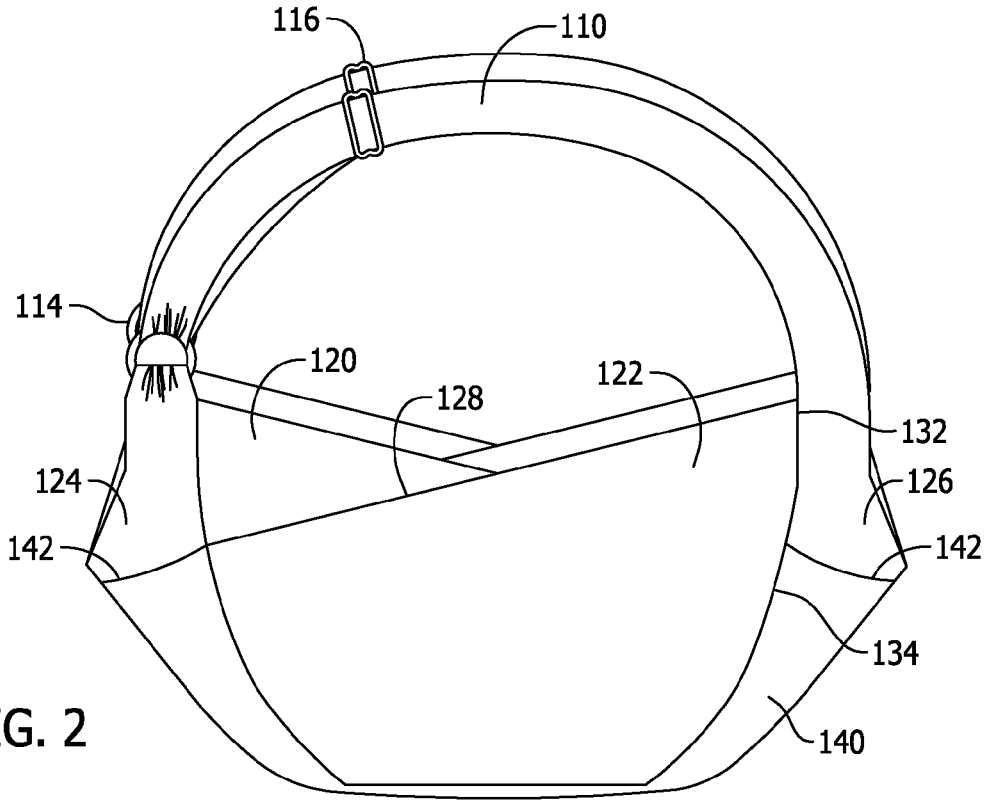
FIG. 2 shows a front view of a carrier for an infant, baby, or small animal, according to an exemplary embodiment.

FIG. 1 shows a side view of a carrier, and FIG. 2 shows a front view of a carrier according to an exemplary embodiment. The carrier 10 comprises two length adjustable straps 110 that allow for easy loading and unloading of the infant, baby, or small animal into a pouch 100. In addition, the two straps 110 are configured to allow the carrier to be worn in a number of positions when standing and when sitting.

For example, the straps 110 may be worn like a satchel on a single shoulder with the pouch 100 resting on an opposite hip area of the user (cross body right or left) or like a purse with the straps 110 on a single shoulder resting on the same hip area of the user (over the shoulder). The wearer may also wear the carrier 10 with the one strap 110 on each should with the pouch 100 worn against the front of the user's torso (front facing). While sitting, the carrier 10 may be worn cross body right, cross body left, or front facing. Further, the wearer may wear the carrier 10 cross body right or left with only one strap 110 on the shoulder, allowing easier access to the pouch 100 while sitting.

The straps 110 are adjustable in length and are wide for comfort and durability. For example, one end of the straps 110 may be threaded through a plastic or metal hoop, ring, or slot 114 and through a metal or plastic slide 116. The length of the strap 110 may be adjusted by pulling or releasing the straps 110 through the slot 114 and slide 116.

The straps 110 may be constructed of any suitable material to accommodate the desired ornamentation and comfort of the wearer. For example, the straps 110 may be formed of a soft foam interior, such as from a polyurethane foam, with a fabric lining surrounding the foam. Other padding or batting may also be incorporated to make the strap sufficiently comfortable. The fabric lining may be comprised of cotton, polyester, nylon, or any other now known or later developed material, or any combination of such materials. The straps 110 may also be formed without padding or batting, and may be comprised of, for example, a polyester webbing, a flexible plastic material, or the like. While two straps 110 are shown in this configuration, a single strap may also be used.

The hoop or slot 114 connects one end of the straps 110 to the pouch 100. The other end of the straps 110 may be fixedly attached to the pouch 100 (see FIG. 2) or may be releasably attached to the pouch 100. For example, both ends of the straps 110 may attach to the pouch 100 via hoops or slots 114. In one embodiment, the sliders 116 may be omitted where the straps 110 are connected to the pouch 100 on both ends by hoops 114. Other releasable or permanent connections now known or later developed may be incorporated.

The pouch 100 is assembled with overlapping layers of diagonally edged panels sewn together in opposite facing directions. For example, the pouch comprises front and back panels 120, 122 and side panels 124, 126. The diagonally edged panels 120, 122, 124, 126 create a resting place (resting notch) on which an infant, a baby, or a small animal's head or other body part may comfortably rest and be supported. In the embodiment shown, all four sides of the pouch include such a resting notch. The overlapping of the fabric panels 120, 122, 124, 126 on all sides provide extra support when assembled, and contribute to the overall shape and design of the carrier. Further, the overlapping panels 120, 122, 124, 126 create front and back storage pockets 128 between the panels 120, 122 and create side storage pockets 130 between the panels 124, 126.

In some embodiments, the resting notch may be v-shaped as shown. However, the resting notch may also be formed, for example, in a U-shape. The resting notch may be formed only on one or some of the sides of the carrier 10. For example, the resting notch may only be on the sides of the carrier 10. Further, while overlapping panels 120, 122, 124, 126 are used in the above embodiment, the sides of the pouch 100 may be formed with a single panel on one or more sides of the pouch 100.

The carrier 100 allows the wearer to support, lift, and bond with an infant, baby, or small animal through a support sleeve 142 disposed on the bottom of the carrying pouch 100. The support sleeve 142 facilitates a user's hand and/or arm to be inserted through the sleeve 142. The wearer thus may optionally provide emotional and physical support, stability, and assistance to the infant, baby, or small animal. This allows the wearer to pamper, connect, touch, lift, reassure and bond with the infant, baby, or small animal.

The sleeve 142 is formed from an additional panel 140 that is placed on the bottom of the pouch 100. The panel 140 is formed to extend from one side of the pouch 100 along the bottom of the pouch 100 to the other side. The panel 140 is constructed of any suitable material provided sufficient strength and stretchability. Such material may include fabrics from synthetic fibers such as are known as Spandex, Lycra, or elastane, or a fabric containing a portion of such fibers. The panel 140 may also be constructed from a non-stretchy material where it is sewn onto the pouch leaving a sufficient space for the wearer's hand and/or arm.

Figure 3:
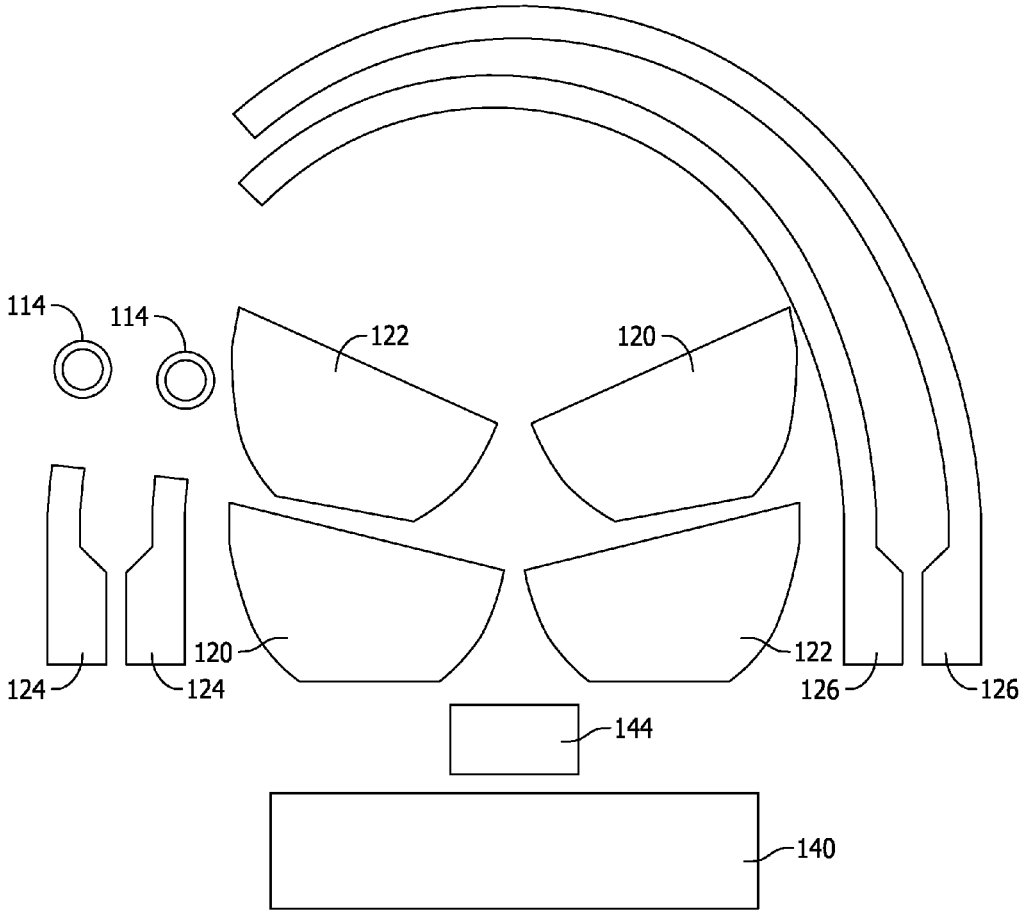
FIG. 3 shows an unassembled, exploded view of a carrier for an infant, baby, or small animal, according to an exemplary embodiment.

The construction of the carrier 10 according to an exemplary embodiment is shown with reference to FIG. 3. In this embodiment, the carrier 10 is formed by four front/back panels 120, 122 and four side panels 124, 126. The front and back panels 120, 122 are overlapped with one another so that the top diagonal edges of the panels 120, 122 form a v-shaped notch. Similarly, the side panels 124, 126 are overlapped with one another so that the top diagonal edges of the panels 124, 125 form a v-shaped notch. Here, the panels 126 are formed integrally with the straps 110. However, the panels 126 could also be formed similar to panels 124 and separately attach to the straps 110.

The side edges of the front panels 120, 122 are seamed together with the side edges of the side panels 124, 126 along the seam 132 (see FIG. 2). A base panel 144 is then seamed to the bottom edges of the panels 120, 122, 124, 126 to form the pouch 100 with storage pockets 128, 130. Of course, the base panel 144 may first be seamed to the bottom edges of the panels 120, 122, 124, 126 prior to seaming the side edges of the panels 120, 122, 124, 126.

The sleeve 140 is then formed by seaming the sleeve panel 142 onto the bottom of the pouch along the seam 134. In this embodiment, the sleeve 140 allows passage of the wearer's hand and arm all the way through the sleeve 140. The rings 114 are attached to the top ends of the panels 124. For example, the top of the panel 124 may be threaded through the rings 114, folded over, and then seamed back onto the panel 114. The straps 110 may then be threaded through the rings 114 and secured by the slide 116.

The seaming to construct the carrier 10 may be done in any suitable manner such as by sewing, by using an adhesive, or by any other method or combination of methods. In other embodiments, fasteners may be used in place of or in addition to the sewing to provide an alternative look to the carrier 10.

Figure 4:
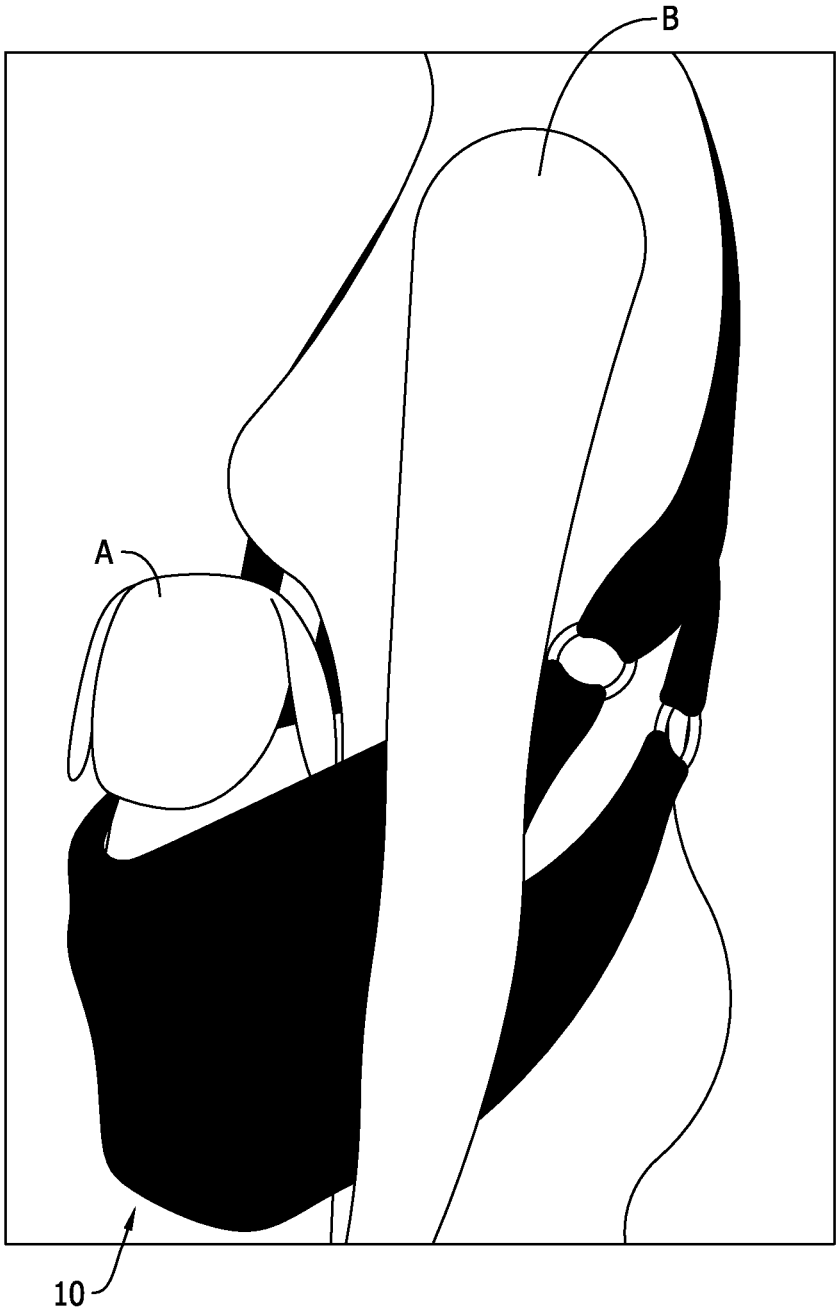
FIG. 4 shows a carrier for an infant, baby, or small animal being worn by a user, according to an exemplary embodiment.

FIG. 4 shows an exemplary embodiment of the carrier 10 in use. The wearer B in FIG. 4 has positioned the two straps 110 so that the carrier 10 is in the cross-body left position. In FIG. 4, a small animal A sits in the pouch, and the wearer B may carry the small animal hands free. With the sleeve 140, the wearer B may optionally insert her or his hands into the sleeve 140 to provide additional support and comfort to the small animal A.

The above described carrier offers a number of advantages. The carrier is easy to use, versatile and designed for the comfort and convenience of the user and comfort and security of the infant, baby, or small animal. The carrier can be worn in a number of different positions by way of the two straps to suit the needs of the infant, baby, or small animal and for the style preferences of the wearer. The dual straps may also allow a user to remove one strap while in a sitting position to for allow easy access to the pouch.

Further, the overlapping panels allow, for example, a small dog to rest its head comfortably on the resting notch in any direction. This also helps such a small dog to be able to see out of the carrier. The overlapping panels also create a number of storage pockets for the wearer to store person items.

The added sleeve along the bottom of the carrier allows the wearer to easily switch from carrying the infant, baby, or small animal hand-free to supporting the infant, baby, or small animal with her or his arms or hands. The wearer may simply insert her or his arms through the sleeve to provide the extra support and/or comfort to the infant, baby, or small animal.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A carrier for carrying an infant, a baby, or a small animal, the carrier comprising:

a pouch comprising a main bottom panel, opposite front and rear panels attached to a front and rear edge of the main bottom panel, and opposite side panels attached to side edges of the main bottom panel and attached to the front and rear panels to form the pouch in which the infant, the baby, or the small animal may sit, the front and rear panels and the side panels each forming a resting notch at a top edge thereof;

two or more straps attached to the opposite side panels, the two or more straps being configured to extend over a wearer's shoulders; and a sleeve disposed underneath the main bottom panel and extending at least partially up over the opposite side panels, the sleeve being configured to allow the wearer's hand or arm to extend therethrough.

2. The carrier according to claim 1, wherein the front and the rear panels each comprise overlapping panels having a diagonal top edge, the diagonal top edge of the overlapping panels forming the resting notch, the resting notch being a v-shaped notch, and the overlapping panels, a seam at the attachment of the overlapping panels to the main bottom panel, and a seam at the attachment of the overlapping panels to the side panels define a storage compartment.

3. The carrier according to claim 1, wherein the two or more straps are adjustable.

4. The carrier according to claim 1, wherein the straps connect to the side panels via hoops.

5. A carrier for carrying an infant, a baby, or a small animal, the carrier comprising:

a pouch in which the infant, the baby, or the small animal may sit comprising a main bottom panel, opposite front and rear panels attached to a front and rear edge of the main bottom panel, the front and the rear panels each comprising first overlapping panels, top edges of the first overlapping panels being oblique forming first v-shaped resting notches where the top edges of the first overlapping panels intersect, and opposite side panels attached to side edges of the main bottom panel pane and attached to the front and rear panels, the opposite side panels each comprising second overlapping panels, top edges of the second overlapping panels being oblique forming second v-shaped resting notches where the top edges of the second overlapping panels intersect;

at least one strap attached to the opposite side panels; and a sleeve disposed underneath and attached to the pouch.

6. The carrier according to claim 5, wherein the opposite side panels comprise a storage pocket between the second overlapping panels defined by the opposite side panels, a seam at the attachment of the opposite side panels to the main bottom panel, and a seam at the attachment of the opposite side panels to the front and rear panels.

7. The carrier according to claim 5, wherein the at least one strap is adjustable in length.

8. The carrier according to claim 5, wherein a first side of the at least one strap is connected to the opposite side panels via a hoop and a second side of the at least one strap is integrally formed with the opposite side panels.

9. The carrier according to claim 5, wherein the at least one strap connects to the side panels via hoops.

10. The carrier according to claim 5, wherein the sleeve is disposed to extend from under the pouch to at least partially up the opposite side panels.

11. A carrier for carrying an infant, a baby, or a small animal, the carrier comprising:

a pouch in which the infant, the baby, or the small animal may sit comprising a main bottom panel, opposite front and rear panels attached to a front and rear edge of the main bottom panel, the front and the rear panels each comprising first overlapping panels, top edges of the first overlapping panels being oblique forming first v-shaped resting notches where the top edges of the first overlapping panels intersect, and opposite side panels attached to side edges of the main bottom panel and attached to the front and rear panels, the opposite side panels each comprising second overlapping panels, top edges of the second overlapping panels being oblique forming second v-shaped resting notches where the top edges of the second overlapping panels intersect;

two straps attached to the opposite side panels that are configured to be worn both with the two straps on one shoulder and with one strap on each shoulder; and a sleeve disposed underneath the main bottom panel and extending at least partially up over the opposite side panels, the sleeve being configured to allow the wearer's hand or arm to extend therethrough.

12. The carrier according to claim 11, wherein the two straps connect to the opposite side panels via hoops.

13. The carrier according to claim 11, wherein a first sides of the two straps are connected to the opposite side panels via hoops and second sides of the strap are integrally formed with the opposite side panels.

* * * * *